United States Patent [19]

Eiermann

[11] 4,165,209

[45] Aug. 21, 1979

[54] EXTERNAL AXLE ROTARY PISTON MACHINE

[75] Inventor: Dankwart Eiermann, Lindau, Fed. Rep. of Germany

[73] Assignee: Wankel GmbH, Berlin, Fed. Rep. of Germany

[21] Appl. No.: 823,137

[22] Filed: Aug. 9, 1977

[30] Foreign Application Priority Data

Aug. 10, 1976 [DE] Fed. Rep. of Germany ..... 2635972

[51] Int. Cl.[2] ..... F04C 29/00

[52] U.S. Cl. ..... 418/190

[58] Field of Search ..... 418/190, 206

[56] References Cited

U.S. PATENT DOCUMENTS

| | | | |
|---|---|---|---|
| 1,645,967 | 10/1927 | Patterson | 418/206 X |
| 2,604,051 | 7/1952 | Johnson | 418/190 |
| 3,439,625 | 4/1969 | Warne | 418/190 |

*Primary Examiner*—Carlton R. Croyle
*Assistant Examiner*—Leonard E. Smith
*Attorney, Agent, or Firm*—Becker & Becker, Inc.

[57] ABSTRACT

A 1:1 ratio rotary piston machine, with an external axle, which operates with interengaging teeth. Each piston has two teeth which mesh with recesses of the counter piston. That entire flank of each tooth which trails in the direction of rotation is set back with respect to the cycloid described by the trailing corner of the pertaining recess of the counter piston. Each recess is deeper than the path of the corners of the intermeshing teeth.

1 Claim, 3 Drawing Figures

EXTERNAL AXLE ROTARY PISTON MACHINE

The present invention relates to a 1:1 ratio rotary piston machine with an external axle which operates by toothed engagement and whose pistons each have two teeth which mesh with recesses in the counter-rotor.

Such machines can be used as power consuming machines, such as blowers or pumps, or as power furnishing machines, for example for driving supercharger blowers, and are suitable both for liquid as well as gaseous media.

Such a machine was first proposed in 1835 by Bellfort in the British patent specification No. 1,430 (see The Engineer of Apr. 28, 1939, page 250). The German patent specification No. 2,232,609 (Offenlegungsschrift) shows a similar machine. Two pistons, which rotate in one housing, have mutually engaging cylindrical main bodies which make rolling contact with each other and on which respectively oppositely located teeth are provided. At a right angle to the axes of the pistons, respectively oppositely located recesses are provided, into which the respective teeth mesh. The synchronization of the rotation of the teeth is effected by a 1:1 ratio drive arranged outside the housing.

The contour on both sides of the teeth defines a cycloid, which is described by the leading corner of the recess of the counter-rotor. The course of the casing of the housing is determined by the path of the corners of the teeth, and, between its two arcs, has an inlet and an outlet, the axis of which is the central normal to the line connecting the piston axes. The apexes of the corners of the teeth can be truncated in a curve which approaches the course of the housing, in order to obtain an extended sealing gap, so that they have leading and trailing tooth corners. Special sealing elements are not described for these machines. The sealing action is effected solely by gaps between the pistons and between the pistons and the housing.

Generally, such machines exhibit the drawback that, during intermeshing of the teeth and the recesses of the counter-piston, undesirable pressure and flow conditions occur which make it impossible from a practical standpoint to obtain high speeds of rotation, even though the completely balanced pistons as such, at least for gaseous media, would allow speeds of rotation, such as are possible with turbines of the same size.

If the contour of the piston recesses engaged or meshed by the teeth is determined by the course of the corners of these teeth, then spaces are formed on both sides of the teeth, which spaces are defined by the corners of the recess and the corners of the teeth. In these spaces a pressure results from the entering of the piston into the recess. Upon further turning of the tooth into the space ahead of the tooth, such pressure, particularly with liquids, is increased excessively in accordance with the speed of rotation.

In order to avoid this effect, channel-like, milled recesses at the bottom of the recess have been suggested. These recesses connect the spaces ahead of and behind the teeth and are supposed to cause a pressure equalization. Furthermore, the recesses, for the same purpose, can be made deeper than the contour as defined by the path of the tooth corners.

In order, however, to avoid leakage between the two pistons, it is not possible to dispense with the gap seal between the tooth flanks and the corners of the recesses of the respective counterpiston, so that the above mentioned measures only achieve a shifting of the trapped, pressurized medium with correspondingly harmful pressure caused leakage around the corners of the pistons. The above mentioned increase in pressure as well as the pressure caused leakage lead to substantial losses of the driving or output power, and, in accordance with the density and viscosity of the medium flowing through, the speed of rotation of the machine is given a fixed limit despite the fully balanced pistons which run completely without any mutual contact.

It is therefore an object of the present invention to at least reduce this drawback and to improve the flow conditions during the intermesh of tooth and recess.

This object and other objects and advantages of the present invention will appear more clearly from the following specification in connection with the accompanying drawings, in which.

The rotary piston machine pursuant to the present invention is characterized primarily be designing the teeth in such a way that the entire flank of each tooth which trails in the direction of rotation is set back with respect to the cycloid described by the trailing corner of the pertaining recess of the counter-piston, and is further characterized in that the recess is deepened with respect to the path of the corner of the tooth. It is advantageous to construct the contour of the trailing flank of the tooth in such a way that it runs approximately parallel to the cycloid described by the trailing corner of the pertaining recess, yet extends from the tooth corner defined by this cycloid to the starting point of the cycloid on the main body of the piston.

The seal between the piston is now effected by the gap formed between the leading flank of the tooth and the leading corner of the recess. The medium trapped between the tooth and the recess is conveyed towards the outflow side of the machine between the trailing flank of the tooth and the trailing corner of the recess.

It has been found surprisingly that the loss of driving or output power is substantially reduced by constructing the pistons according to the present invention, and that the present machine, with the same power, can be driven at substantially higher speeds of rotation of the piston than can heretofore known tooth and recess constructions, i.e., with a substantially higher throughput of the medium. Such present machines can, for example, be used advantageously in pairs, with pistons running on the same shafts, as exhaust superchargers.

Figure 1:
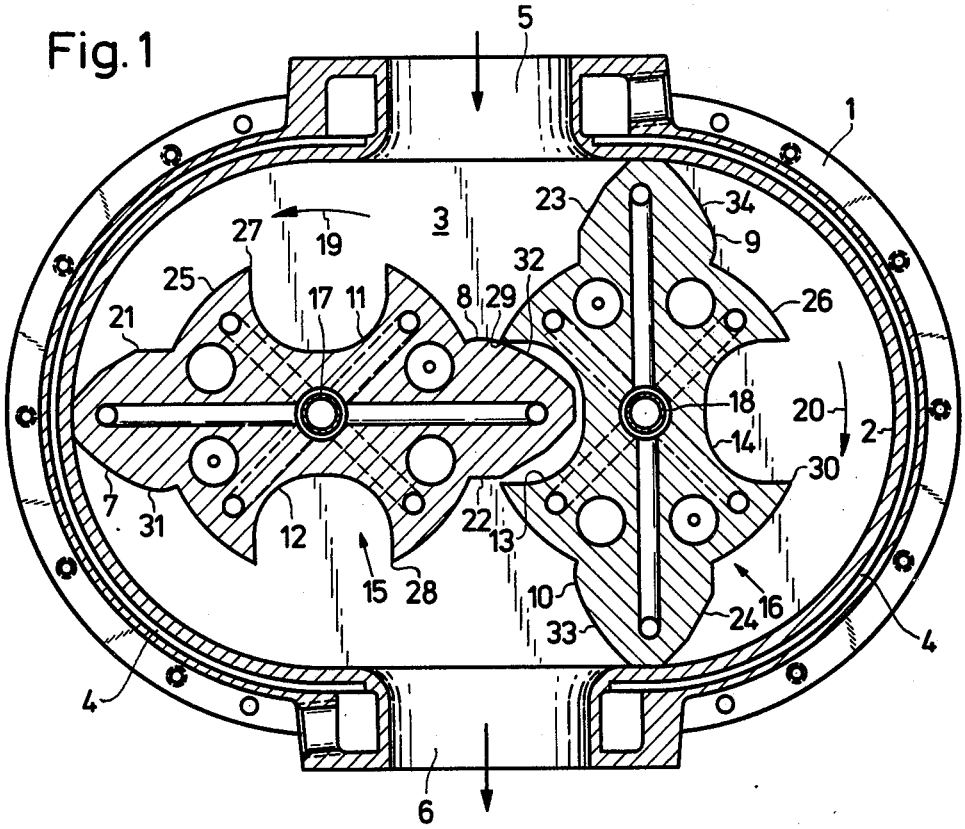
FIG. 1 is a radial section through a rotary piston machine pursuant to the present invention operating as an exhaust supercharger.
Figure 2:
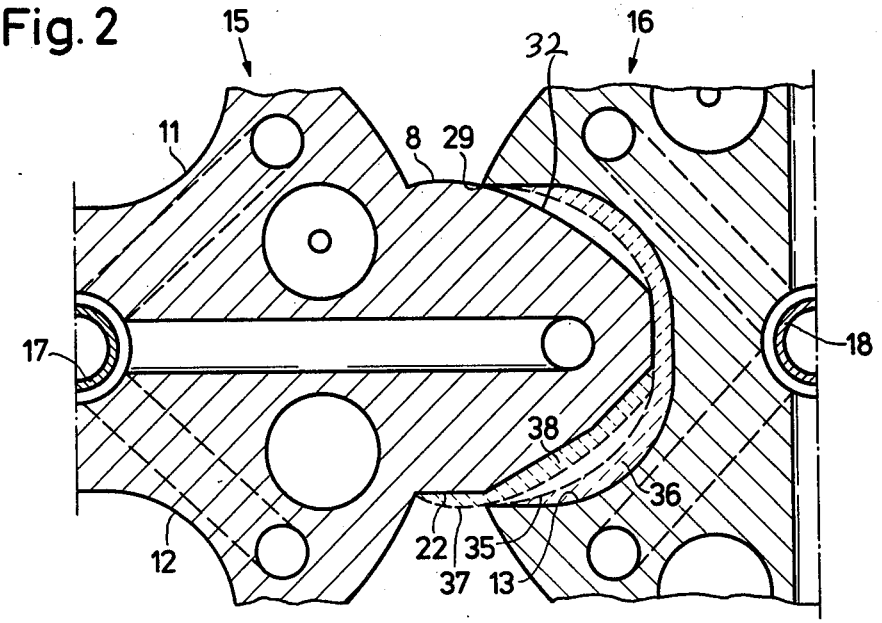
FIG. 2 is an enlargement of a portion of FIG. 1.

Referring now to the drawings in detail, the machine shown in FIGS. 1 and 2 has a housing 1 which comprises a casing 2 and side walls 3, of which only one is shown. In the casing 2, cooling spaces 4 are provided for liquid cooling. The casing 2 has an inlet 5, which connects the inner space of the machine at the inlet side with a supply line for the charging air. The casing 2 also has an outlet 6, which leads from the inner space at the outlet side to the inlet of an internal combustion engine. Each of the pistons 15 and 16 has two teeth 7,8 and 9, 10 respectively and two recesses 11,12 and 13,14 respectively, and are fixedly connected to shafts 17 and 18 respectively. On these shafts are fixedly arranged other pistons which drive the shafts and are acted upon by the exhaust gas of the internal combustion engine. These other pistons constitute a power supply machine, not shown, of the same general construction and corresponding dimensions. The direction of rotation of the pistons is shown by the arrows 19 and 20.

Those flanks of the teeth 7,8,9 and 10 which lie to the rear with regard to the direction of rotation have milled portions 21, 22, 23 and 24, which set back these flanks inwardly with respect to the cycloidal shape possessed by the leading flanks. The recesses 11, 12, 13 and 14 are deepened relative to the path of the piston corners. The teeth 7,8,9,10 are broadened out at their apexes in order to form contact surfaces, which are parallel to the curvature of the housing casing, so as to produce longer sealing gaps. As a result, each tooth apex forms two corners. The pistons on all sides run free of contact, and the seal is effected solely by the formation of narrow gaps between the teeth and the housing, between the round main bodies 25 and 26 of the pistons 15 and 16, which bodies 25,26 make rolling contact with each other, and between the leading corners 27,28,29 and 30 of the recesses 11, 12, 13 and 14 and the leading cycloidal tooth flanks 31,32,33 and 34. The contours of these tooth flanks 31,32,33 and 34 are determined by the movement of the leading corners 27,28,39 and 30 of the recesses, so that these corners remain in engagement with the flanks 31, 32,33 and 34 during the entire passing of the latter.

FIG. 2 shows the meshing of the tooth 8 of the piston 15 in the recess 13 of the piston 16. The dashed line 35 indicates the path of the piston corners. The resulting area between the line 35 and the recess 13 represents the deepening 36 of the recess 13 with respect to the path of the corners. This deepening results in a space for pressure equalization between the spaces ahead of and behind the tooth 8. The dashed line 37, which corresponds to the cycloidal curve of the leading tooth flank 32, defines the periphery of the milled portion 38, by which the tooth flank 22 is set back.

The air trapped in the recess 13 can escape between the trailing tooth flank 22 and the trailing corner of the recess 13, which cannot come into contact with this flank 22, into the space on the outflow side of the machine without any substantial flow losses, while the leading corner 29 of the recess 13, in constant contact with the leading cycloidal tooth flank 32, forms the seal between the pistons during passing of the tooth 8 through the recess 13. After this passing, the sealing action is performed by the main bodies 25 and 26 which make rolling contact with each other, so that the pistons are always sealed with regard to one another.

Figure 3:
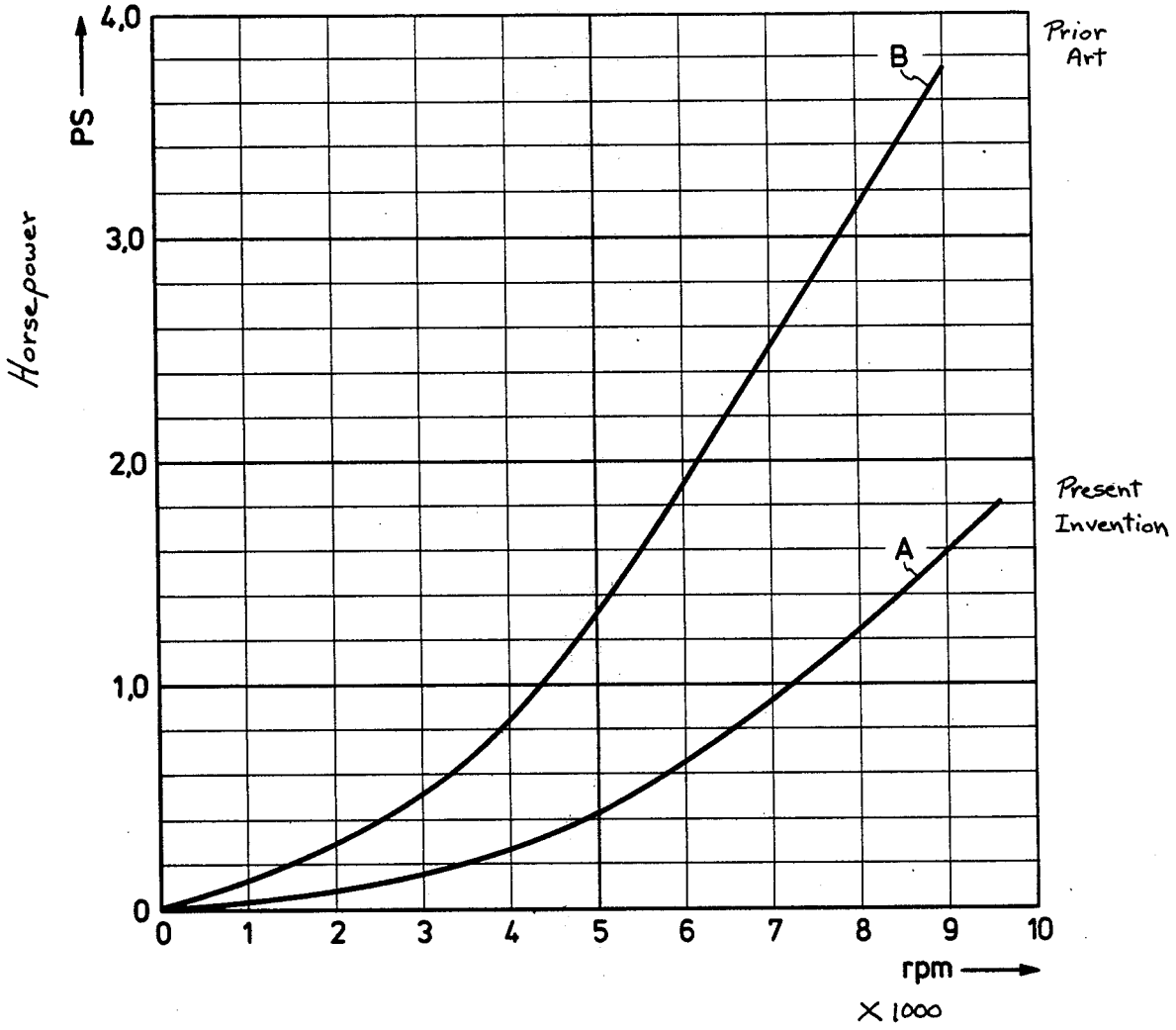
FIG. 3 is a graph in which the driving power is plotted against the speed of rotation for both a machine according to the present invention (A) and a prior art machine of the same size and of generally similar construction (B).

In the graph of FIG. 3, the vertical axis represents the driving power (PS-metric horsepower) supplied by the exhaust machine and the horizontal axis represents the speed of rotation (rpm) of the piston. This graph shows curve A, which represents values for a machine according to the present invention, and curve B, which represents values, for purposes of comparison, which were obtained with the same machine, but operating with pistons on which the trailing tooth flanks were not machined away, that is, had the same contours as the leading tooth flanks, i.e., the trailing tooth flanks had a shape as indicated by the dashed line 37, in FIG. 2. The surprising result shows that to achieve a speed of rotation of the pistons of 9000 rpm, at which a satisfactory degree of charging can still be obtained, for the machine according to the present invention it was only necessary to provide half the driving power required by the same machine having pistons of a conventional construction, that is, pistons with symmetrical teeth with cycloidal contours on both sides. Thus, with a machine equipped with conventional pistons, difficulties arise in attaining the above mentioned speed of rotation with the driving power which can be provided by an exhaust machine.

It is, of course, to be understood that the present invention is by no means limited to the specific showing of the drawings, but also encompasses any modifications within the scope of the appended claims.

What I claim is:

1. A 1:1 ratio external axle rotary piston machine which comprises in combination: pistons which intermesh with one another, each of said pistons having two respectively oppositely located truncated teeth with corners as well as a base and two respectively oppositely located recesses with corners interposed between said teeth, said pistons being arranged in such a way that alternately one tooth of one piston engages one recess of another piston and vice versa, that entire flank of each tooth having a side which trails in the direction of rotation of the pertaining piston being provided with a contour and being set back with respect to the cycloidal path described by the trailing corner of the pertaining recess of the piston engaged by said tooth, each recess being deeper than the path of the corners of the pertaining engaging tooth, said contour of said set back trailing flank of each tooth being approximately parallel to said cycloidal path described by the trailing corner of the pertaining recess of the piston engaged by said tooth, said contour extending from the trailing corner of said tooth to the base of said tooth on said trailing side thereof, said base coinciding with said cycloidal path where the latter intersects with the piston.

* * * * *